United States Patent [19]

Price

[11] Patent Number: 4,571,793

[45] Date of Patent: Feb. 25, 1986

[54] AIR JET TEXTURING SYSTEM FOR THE PRODUCTION OF UNIFORM TEXTURED YARN

[75] Inventor: Samuel T. Price, Homosassa, Fla.

[73] Assignee: Enterprise Machine and Development Corp., Wilmington, Del.

[21] Appl. No.: 637,126

[22] Filed: Aug. 2, 1984

Related U.S. Application Data

[62] Division of Ser. No. 471,239, Mar. 2, 1983.

[51] Int. Cl.[4] ..... D02G 1/16; D02J 1/14

[52] U.S. Cl. ..... 28/220; 264/289.6

[58] Field of Search ..... 264/289.6, 290.5; 28/220, 271, 272, 221, 245, 246, 248

[56] References Cited

U.S. PATENT DOCUMENTS

| | | | |
|---|---|---|---|
| 2,549,014 | 4/1951 | Romeyn, Jr. | 28/246 X |
| 3,003,222 | 10/1961 | Pitzl | 264/289.6 |
| 3,222,859 | 12/1965 | Joly | 28/220 |
| 3,517,498 | 6/1970 | Burellier et al. | 28/271 X |
| 3,651,198 | 3/1972 | Mitsuishi et al. | 264/290.5 |
| 3,703,753 | 11/1972 | Binford et al. | 28/220 |
| 3,765,069 | 10/1973 | Fujita et al. | 28/246 X |
| 3,878,178 | 4/1975 | Guinn et al. | 28/246 X |
| 4,192,047 | 3/1980 | Foster et al. | 28/220 |
| 4,338,776 | 7/1982 | Krenzer | 28/271 |

FOREIGN PATENT DOCUMENTS

| | | | |
|---|---|---|---|
| 41-6212 | 4/1966 | Japan | 264/290.6 |
| 45-34404 | 11/1970 | Japan | 264/290.5 |

*Primary Examiner*—Werner H. Schroeder
*Assistant Examiner*—Andrew M. Falik
*Attorney, Agent, or Firm*—Mortenson-Uebler

[57] ABSTRACT

A new process is provided for producing highly resilient, textured, continuous multifilament polymeric yarns and combinations of such yarns with other continuous filament yarns and with spun yarns. The unstable or wild loops which form in conventional air jet textured yarns are substantially eliminated in the product yarns of this invention. The product yarns are formed by continuously drawing polymeric yarn under controlled temperature conditions, texturing the yarn in an air jet texturizer and subjecting the textured yarn to saturated steam while restraining the linear shrinkage of the yarn in the presence of the steam, followed by continuous take-up of the yarn on a package.

14 Claims, 5 Drawing Figures

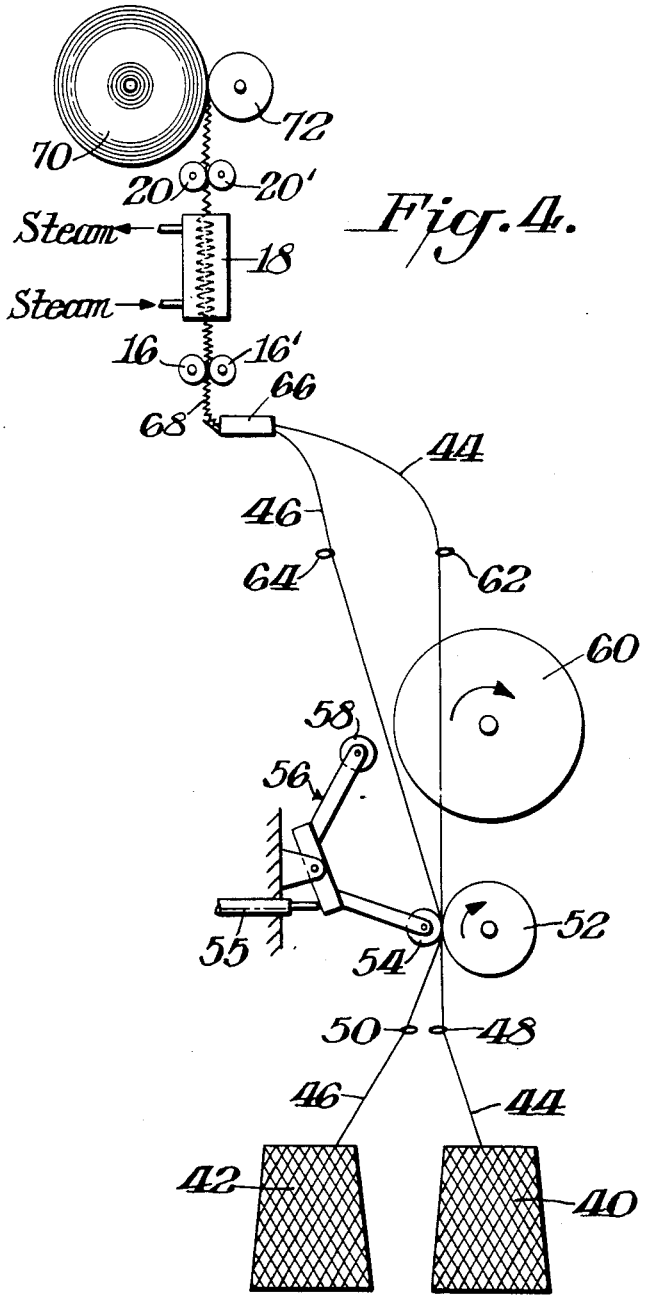
Fig. 4.
Fig. 5.
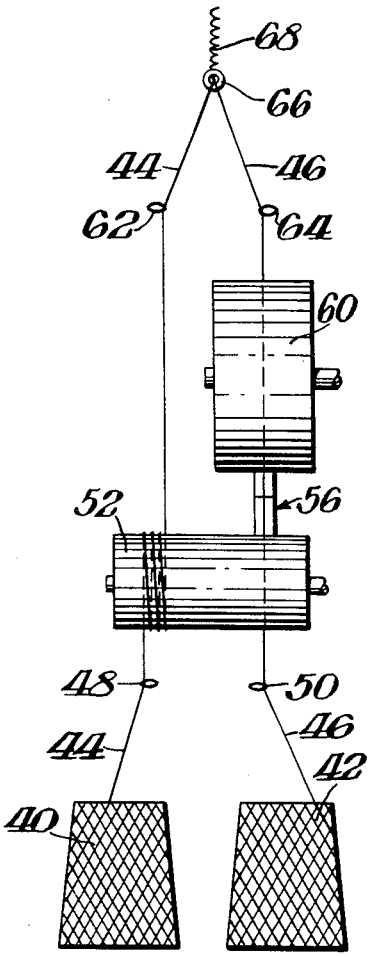

AIR JET TEXTURING SYSTEM FOR THE PRODUCTION OF UNIFORM TEXTURED YARN

This application is a divisional of copending U.S. patent application Ser. No. 471,239, filed Mar. 2, 1983.

BACKGROUND OF THE INVENTION

This invention relates generally to a yarn texturing air jet system and the products produced thereby. More specifically, the invention relates to the textured yarn products produced by a process of continuously drawing continuous filament synthetic polymeric yarn under controlled temperature conditions, air jet texturing the drawn yarn and then subjecting the textured yarn to saturated steam while restraining the yarn from shrinking during steam treatment.

Bulky or crimped yarns composed of continuous synthetic fiber-forming polymers such as polyester and polyamide can be produced by feeding yarn filaments with overfeed to an air jet texturizer to produce a large number of random loops or crimps in the yarn. The type and degree of texture in the product yarn produced by such techniques depends upon the amount of twist in the feed yarn and on the amount of overfeed in the texturing jet. The product yarn is generally spooled under tension and this product generally has poor linear stability and high boiling shrinkage values. The yarns are characterized by the presence of many ring-like or crunodal loops at irregular intervals along the surface of the yarn and internally in the yarn bundle.

When prior air jet texturing techniques according to the above are employed, a certain number of unstable or "wild" loops are generated in a random fashion along the yarn. These unstable loops can extend outwardly from the yarn bundle and adversely affect the yarn take off in subsequent textile mill operations. In fabrics made from such yarns, a "Velcro" or picky type characteristic may appear, and this is generally distasteful in apparel.

Methods are known for controlling these unstable loops to varying degrees. U.S. Pat. No. 4,338,776 (Krenzer) describes a process and apparatus for producing a crimped continuous multifilament yarn by the sequential steps of air-jet texturing to form multiple random filamentary loops, immediately pulling out metastable loops formed in the yarn without heating and without stretching or deforming the yarn filaments, next shrinking and heat setting the yarn at a temperature of about 150°–245° C., and then winding the yarn onto a spool at a predetermined yarn tension. The non-crimped multifilament feed yarn is conducted through an air jet texturing nozzle at an overfeed rate said to be sufficient to form multiple random loops in the individual filaments, including some proportion of unstable loops. Following passage through the air jet, the yarn is conducted to feed and draw rolls in a heat free condition such that at least some of the unstable loops are pulled out of the yarn.

Prior known methods of controlling the unstable or wild loops are generally expensive and marginally effective. The present invention provides an effective and inexpensive method and apparatus for producing air jet textured yarns with substantially no unstable or wild loops. One product of this invention results from the phenomenally high shrinkage inherent in cold-drawn partially oriented polyester, polyamide and similar yarns. The linear behavior of these yarns according to the invention is controlled by tension at the entrance and exit ends of a steam chamber wherein a modest latent stretch is deliberately retained in order to improve the transverse fiber properties resulting in enhanced fabric resilience.

The following definitions apply to terms of the art as used in this specification. The term "fully oriented yarn" denotes a polymeric yarn drawn to such an extent that its molecules are fully oriented and very little further extensibility is possible in a cold, i.e. unheated, condition without breaking. This is the most stable yarn condition, total recovery or relaxation occurs on heating in an unrestrained state, however there is a loss of transverse quality or resilience of the yarn.

"Undrawn yarn" denotes continuous filament yarn in a totally undrawn state or as-spun condition.

The term "partially oriented yarn" denotes a polymeric yarn drawn to an extent such that its molecules are somewhat or "partially" oriented, but the extent of draw is less than that for fully drawn yarn. The resilience of partially drawn yarn is improved compared to fully drawn yarn, resulting in improved wrinkle resistance in fabrics made from such yarn.

The term "spun yarn" as used herein denotes any yarn made from relatively short discontinuous yarn ends that are reconstituted by twist or other means to form continuous lengths of yarn of commercial usefulness. These yarns can be made of synthetics or of natural fibers such as cotton or wool.

SUMMARY OF THE INVENTION

A process is provided for the production of highly resilient textured continuous multifilament yarn or combinations of spun and multifilament yarn comprising feeding at least one end of a continuous filament synthetic polymeric feed yarn to and through a feed roll system and thence to and through a draw roll system whereby the feed yarn is drawn, conducting the drawn yarn to a texturing air jet system, either singly or combining the drawn yarn at the entrance end of the jet with at least one other yarn, conducting the yarn end or combined ends through the jet, thereby forming multiple random loops in the individual filament(s), including a proportion of random unstable loops, conducting the yarn end or combined ends leaving the air jet to and through a second feed roll system which feeds the yarn at a controlled rate into and through a steam chamber containing saturated steam, the yarn exiting the steam chamber being conducted to and through a fourth roll system operating in cooperation with the second feed roll system to restrain and control the shrinkage of the yarn within the steam chamber, and thence guiding the drawn, textured and steam treated yarn to a take-up system, thereby producing a highly resilient textured product having substantially no unstable loops, with some or all of the yarn exhibiting less than fully oriented fiber birefringence. When the feed yarn is partially oriented polyester, polyamide or similar yarn, it is drawn cold, i.e. in ambient conditions in the absence of heat. When fully oriented yarn is employed, the drawing is carried out at an elevated temperature to an extent of about 20 to about 35 percent.

Preferred feed yarns are polyester, polyamide, polyolefin and similar yarns, in combination with polyester, polyamide, polyolefin, cellulose acetate and other continuous multifilament yarns and in combination with spun yarns, both synthetic and natural such as cotton.

A process is also provided for the production of a highly resilient continuous filament yarn comprising feeding at least one end of a continuous filament partially oriented synthetic polymeric feed yarn to and through a feed roll system and thence to and through a draw roll system whereby the feed yarn is cold-drawn, i.e. in the absence of heat, conducting the drawn yarn to and through a second feed roll system which feeds the yarn at a controlled rate into and through a steam chamber containing saturated steam, the yarn exiting the steam chamber being conducted to and through a fourth roll system operating in cooperation with the second feed roll system to restrain and control the shrinkage of the yarn within the steam chamber and thence guiding the drawn and steam treated yarn to a take-up system, thereby producing a highly resilient yarn filament exhibiting less than fully oriented fiber birefringence. This yarn is then fed to a process for the production of a highly resilient textured continuous multifilament core and effect yarn. Preferred feed yarns and combinations are as described above.

Also claimed are the products produced by these processes.

BRIEF DESCRIPTION OF THE DRAWINGS

FIG. 4 is a schematic side elevational view of apparatus for making a core and effect yarn according to this invention.

FIG. 5 is an end elevation of the apparatus of FIG. 4.

Figure 1:
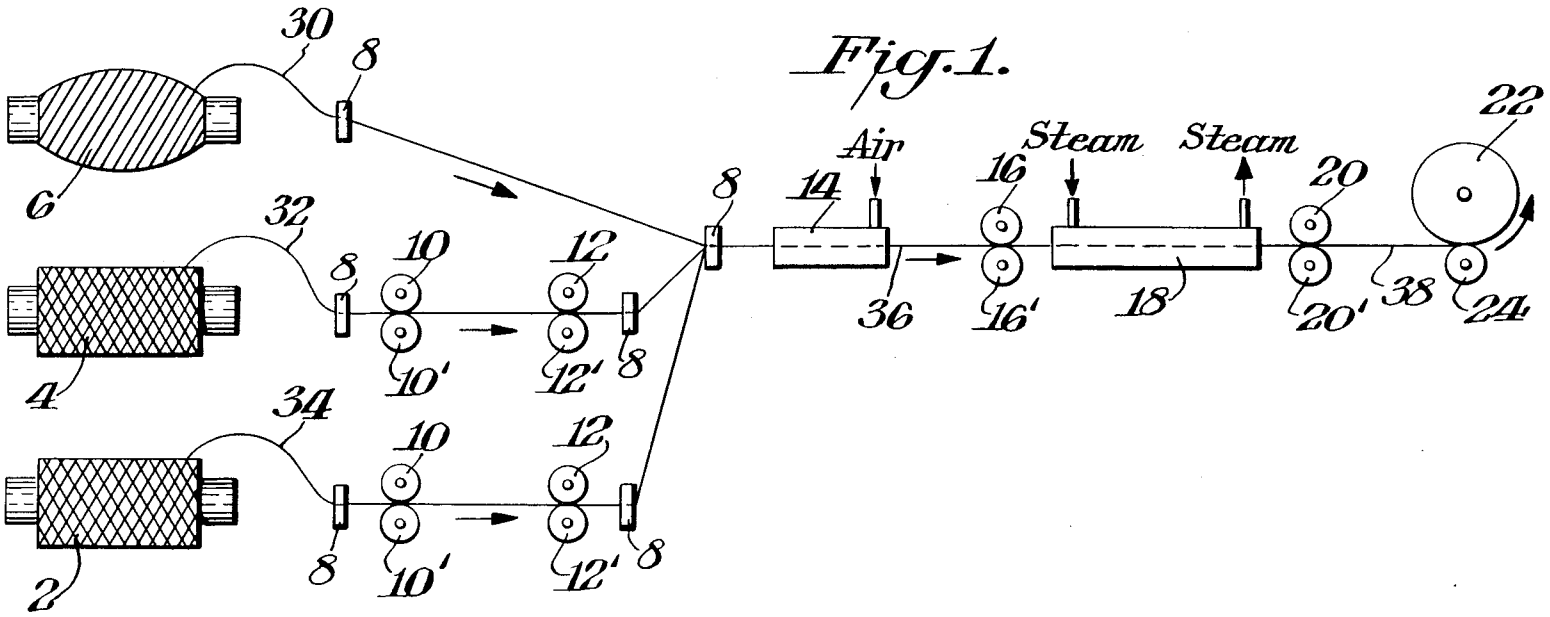
FIG. 1 is a schematic diagram of the yarn drawing, texturing and steam treating process of this invention.

DETAILED DESCRIPTION OF THE INVENTION AND PREFERRED EMBODIMENTS WITH REFERENCE TO THE DRAWINGS

A new process is provided for producing highly resilient, textured, continuous multifilament polymeric yarns and combinations of such yarns with other continuous filament yarns and with spun yarns. The unstable or wild loops which form in conventional air jet textured yarns are substantially eliminated in the product yarns of this invention. The product yarns are formed by continuously drawing polymeric yarn under controlled temperature conditions, texturing the yarn in an air jet texturizer and subjecting the textured yarn to saturated steam while restraining the linear shrinkage of the yarn in the presence of the steam, followed by continuous take-up of the yarn on a package.

A fundamental physical concept leading to the present invention was the recognition of the phenomenal shrinkage which takes place when partially oriented or fully oriented polyester yarn is exposed to a hot wet medium. Initial experiments indicated that cold drawn polyester yarn samples drawn to approximately a 1.45 or as much as 1.6 draw ratio and exposed to boiling water at open atmospheric conditions (approximately 210 degrees Fahrenheit) shrank virtually instantaneously and wild loops present in the yarn prior to immersion disappeared completely.

In a continuous process, which is preferred, it was determined that partially oriented polyester yarn could be cold drawn, i.e. in the absence of heat, bulked with an air jet texturizer and then passed through a steam chamber using steam at 25 to 30 pounds per square inch, there being restraining rolls at the entrance and exit ends of the steam chamber to restrain and control the shrinkage of the yarn while in the steam chamber. According to the principles of this invention, the linear speed of the yarn through the exit rolls in the range of about 0.8 to 2.0 times the linear speed of the yarn through the entrance rolls, the linear shrinkage of the yarn being in the range of about 20 to about 100 percent.

The highly resilient yarns produced according to this invention are characterized by having less than complete fiber orientation as manifested, for example, by exhibiting less than fully drawn fiber birefringence. This characteristic is defined as the difference between the principal refractive index in the stretch direction and the principal refractive index perpendicular to the stretch direction.

The yarn produced according to this invention may be combined with virtually any other yarn including, without limitation, continuous filament polyester, polyamide, polyolefin, cellulose acetate, and other similar yarns, as well as spun yarns including synthetics and natural fibers such as cotton. While not fully understood, it is believed that, upon restrained linear shrinkage in the steam chamber, the wild loops in the drawn yarn gather in the companion yarn such as cotton and hold the latter in intimate contact.

Cold drawn, untextured but steam treated yarns according to this invention are believed to be useful in otherwise conventional core and effect yarn systems to economically product synthetic yarns which are silk-like both in tactile and in visual character. In general, the yarns produced according to this invention include conventional fine denier applications of single or multiple ends of continuous filaments for use in apparel and other applicants including sewing thread and fenestration yarns. The system may provide an ideal approach in combining spun yarns with continuous filament yarns by employing the shrinkage of the filament loops to trap filament ends in the spun yarn and establish an integrated product. The process also includes a method by which fully drawn yarns can be destabilized by drawing with a subsequent reduction of the wild loops by steam treating resulting in improved yarns for sewing thread, upholstery and fenestration yarns. Means are further provided by which short, but random, non-uniformities can be introduced to overcome the plastic appearance of conventional continuous filament products.

A detailed description of the process and products of this invention is best provided with reference to the accompanying drawings. FIG. 1 is a schematic diagram of one preferred embodiment of the process of the invention. FIG. 1 shows continuous filament polymeric yarns 32 and 34 being fed from supply yarn packages 4 and 2 respectively to feed rolls 10 and 10' and thence to and through draw rolls 12 and 12' which run at a faster speed than the feed rolls and thereby impart draw to the yarn. Preferred draw ratios range from about 1.45 to about 1.6 when partially oriented yarn is used as the feed yarn. If fully oriented yarn is fed as filaments 32 and 34, this yarn is preferably drawn about 20 to about 35% at an elevated temperature in the range of about 215 to about 280 degrees Fahrenheit for polyester yarns. The heating can be accomplished by using heated feed rolls 10 and 10' and draw rolls 12 and 12' (or an intermediate heating device) and wrapping the filaments about these rolls several times to provide residence time under temperature. Following drawing, the drawn yarn is guided to an air jet texturizer 14 by guides 8 where it may be combined with another yarn 30 fed from package 6 as shown which may be a spun yarn, not drawn, for example. The textured multifilament yarn 36 exiting the air jet is guided to and through feed rolls 16 and 16' and into and through the steam chamber 18 where it is subjected to saturated steam at about 220 to about 300 degrees Fahrenheit. The steam treated yarn passes through rolls 20 and 20' which, as aforesaid, control the speed, tension and thus the linear shrinkage of the yarn bundle at desired degrees. The highly resilient drawn, textured and steam treated yarn 38 is then wound upon yarn package 22, with the aid of stabilizer roll 24, thus providing the product yarn according to this invention.

Figure 3:
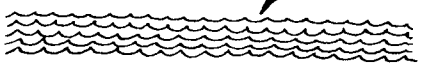
FIG. 3 is a schematic diagram of a texture multifilament yarn according to this invention having substantially no unstable loops.
Figure 2:
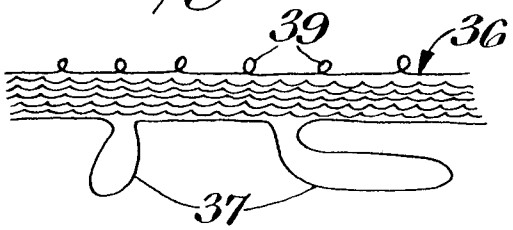
FIG. 2 is a schematic diagram of a conventional textured multifilament yarn having stable and unstable loops.

FIG. 2 illustrates schematically the stable crunodal loops 39 in multifilament yarn 36 produced by conventional texturing means and random unstable loops 37. Following steam treatment according to this invention the unstable loops are substantially eliminated as depicted in FIG. 3.

In another embodiment using the yarn of this invention, a core and effect yarn is produced as depicted in FIGS. 4 and 5. Therein, feed yarns 44 and 46 fed from yarn supplys 40 and 42, respectively, proceed through otherwise conventional core and effect yarn apparatus. At least one of the feed yarns is made as described in connection with FIG. 1 but eliminating the air jet texturing. That is, at least one of the feed yarns in FIG. 4 has been drawn but not steam treated or textured as shown in FIG. 1. The core yarn 44 shown in FIG. 4 is fed at a constant rate through the roll system and to and through the air jet texturizer 66. The effect yarn 46 is caused to create thick sections by overfeeding this yarn at desired time intervals by means of roll 60 and roll 58 causing yarn 46 to overfeed to jet 66. When thin sections are desired, rocker arm 56 is caused to disengage roll 58 from roll 60 and roll 54 in cooperation with roll 52 slows the speed of filament 46, thereby producing a thin section. The engagement or disengagement of rolls 54 and 58 can be controlled as desired using known fluidics techniques, not shown except for air signal tube 55. Upon removal of the air signal, spring mechanism 57 causes rolls 52 and 54 to disengage and rolls 58 and 60 to engage to overfeed yarn 46. The textured yarn 68 exiting the air jet is guided to and through feed rolls 16 and 16' and into and through the steam chamber 18 where it is subjected to saturated steam. The steam treated yarn passes through rolls 20 and 20' which control the speed, tension and linear shrinkage of the yarn at desired degrees. The thick and thin core and effect yarn 68 produced according to this method is collected on take-up roll 70 with the aid of stabilizer roll 72. This yarn so produced should have a broad range of more exotic end uses, with a broad range of appearance and slub density tailored for style, having tactile and visual characteristics of silk.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

I claim:

1. A process for the production of highly resilient textured continuous filament yarn comprising:

feeding at least one end of a continuous filament, at least partially oriented synthetic polymeric feed yarn to and through a feed roll system and thence to and through a draw roll system whereby the feed yarn is drawn, conducting said drawn yarn to a texturing air jet system, conducting said yarn end through said jet, thereby forming multiple random loops in the yarn end including a proportion of random unstable loops, conducting the yarn leaving said air jet to and through a second feed roll system which feeds said yarn at a controlled rate into and through a steam chamber containing saturated steam at about 220 to about 300 degrees Fahrenheit thereby substantially eliminating said random unstable loops, the yarn exiting the steam chamber being conducted to and through a fourth roll system operating in cooperation with said second feed roll system to restrain and control the linear shrinkage of said yarn within the steam chamber, and thence guiding the drawn, textured and steam treated yarn to a take-up system, thereby producing a highly resilient textured yarn having substantially no unstable loops, said yarn exhibiting less than fully oriented fiber birefringence.

2. A process according to claim 1 wherein said drawn yarn is combined at an entrance end of said jet with at least one other yarn, conducting the combined yarn ends through said jet, thereby forming multiple random loops in the individual filaments including a proportion of random unstable loops, conducting the multifilament yarn leaving said air jet to and through a second feed roll system which feeds said yarn at a controlled rate into and through a steam chamber containing saturated steam at about 220 to about 300 degrees Fahrenheit, the yarn exiting the steam chamber being conducted to and through a fourth roll system operating in cooperation with said second feed roll system to restrain and control the linear shrinkage of said yarn within the steam chamber, and thence guiding the drawn, textured and steam treated yarn to a take-up system, thereby producing a highly resilient textured multifilament yarn having substantially no unstable loops, said yarn exhibiting less than fully oriented fiber birefringence.

3. The process of claim 2 wherein said other yarn is continuous filament polyester yarn.

4. The process of claim 2 wherein said other yarn is continuous filament polyamide yarn.

5. The process of claim 2 wherein said other yarn is continuous filament polyolefin yarn.

6. The process of claim 2 wherein said other yarn is continuous filament cellulose acetate yarn.

7. The process of claim 2 wherein said other yarn is a spun yarn.

8. The process of claim 7 wherein said other yarn is cotton.

9. The process of claim 2 wherein a multiplicity of continuous filament synthetic thermoplastic feed yarns are fed to the system.

10. The yarn produced by the process of claim 2, said feed yarn being a yarn at least partially oriented and drawn without added heat, said feed yarn having less than complete fiber orientation as manifested by exhibiting less than fully drawn fiber birefringence, and exhibiting linear shrinkage in the presence of saturated steam in the range of 20% to 100%.

11. The process of claim 1 wherein said feed yarn is partially oriented yarn which is cold-drawn in said process, i.e. without added heat.

12. The process of claim 1 wherein said feed yarn is fully oriented yarn which is drawn in said process about 20 to 35 percent at elevated temperature.

13. The process of claim 1 wherein said feed yarn is selected from the class consisting of polyester, polyamide, polyolefin, vinyl and acrylic polymers.

14. The yarn produced by the process in claim 4 being a yarn at least partially oriented and drawn without added heat, said product having less than complete fiber orientation as manifested by exhibiting less than fully drawn fiber birefringence, and exhibiting linear shrinkage in the presence of saturated steam in the range of about 20% to 100%.

* * * * *